US008238774B2

(12) United States Patent
Takada

(10) Patent No.: US 8,238,774 B2
(45) Date of Patent: Aug. 7, 2012

(54) IMAGE FORMING APPARATUS AND CONTROL METHOD FOR THE SAME

(75) Inventor: Setsuo Takada, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 547 days.

(21) Appl. No.: 12/418,730

(22) Filed: Apr. 6, 2009

(65) Prior Publication Data

US 2009/0257766 A1 Oct. 15, 2009

Related U.S. Application Data

(60) Provisional application No. 61/044,218, filed on Apr. 11, 2008.

(51) Int. Cl.
*G03G 15/20* (2006.01)

(52) U.S. Cl. ..... 399/69

(58) Field of Classification Search ..... 399/33, 399/38, 67–70, 320, 328–332; 219/216, 219/619

See application file for complete search history.

(56) References Cited

U.S. PATENT DOCUMENTS 7,428,389 B2 * 9/2008 Kikuchi ..... 399/67
7,623,802 B2 * 11/2009 Takagi et al. ..... 399/67
7,787,789 B2 * 8/2010 Nakayama et al. ..... 399/69

* cited by examiner

*Primary Examiner* — Hoan Tran

(74) *Attorney, Agent, or Firm* — Turocy & Watson, LLP

(57) ABSTRACT

An image forming apparatus having a fixing device 26 that includes a fixing roller 30, a center coil 33*a* for induction heating a substantially central part in the axial direction of the fixing roller 30, side coils 33*b*, 33*c* for induction-heating end parts in the axial direction of the fixing roller, induction heating power sources 60, 61, 70, 71 which supply a high-frequency pulse voltage to these coils, and a power control circuit 58*a* which variably controls output power of the induction heating power sources 60, 61, 70, 71 so that the output power increases or decreases stepwise on a predetermined cycle, and has a function of selectively setting maximum power supply and a function of selectively setting the output power variance cycle.

20 Claims, 10 Drawing Sheets

| OPERATION PATTERN | CENTER COIL OPERATING TIME (sec) | SIDE COIL OPERATING TIME (sec) |
|---|---|---|
| 12 | 1.5 | 1 |
| 13 | 1.4 | 1 |
| 14 | 1.3 | 1 |
| 15 | 1.2 | 1 |
| 16 | 1.1 | 1 |
| 17 | 1 | 1 |
| 18 | 1 | 1.1 |
| 19 | 1 | 1.2 |
| 20 | 1 | 1.3 |
| 21 | 1 | 1.4 |
| 22 | 1 | 1.5 |

IMAGE FORMING APPARATUS AND CONTROL METHOD FOR THE SAME

CROSS-REFERENCE TO RELATED APPLICATION

This application is based upon and claims the benefit of priority from provisional U.S. Application 61/044,218 filed on Apr. 11, 2008, the entire contents of which are incorporated herein by reference.

TECHNICAL FIELD

The present invention relates to a fixing device used in an electrographic image forming apparatus such as a copy machine or printer, and particularly to a fixing device employing a heating system using a high frequency induction coil (hereinafter referred to as IH coil).

BACKGROUND

As a conventional method for power supply to an IH coil in a fixing device using the IH coil, a so-called on-off control system is employed in which the surface temperature of a fixing belt is detected, and if a target temperature is not reached, the maximum power is supplied from a heating source, and after the target temperature is reached, the supply from the heating source is reduced or turned off. A conventional image forming apparatus has two operation modes, that is, a normal paper mode for forming an image on a normal paper having a relatively small basis weight of sheet, and a thick paper mode for forming an image on a thick paper having a large basis weight of sheet. In the normal paper mode, the carrying speed of the fixing belt in the fixing device is a normal speed. On the other hand, in the thick paper mode, deceleration running is carried out, for example, at a ⅓ speed of the normal speed in order to sufficiently fix an image to the thick paper having a large basis weight.

However, in the thick paper mode, because of the large basis weight of sheet, even if the fixing belt is caused to run at a decelerated speed, the surface temperature of the fixing belt does not quickly reach a target temperature particularly when a fixing member is cooled. Therefore, maximum power is applied. Consequently, there is a problem of increased temperature ripple. This temperature ripple is a phenomenon that the surface temperature of the fixing belt changes above and below a target temperature in a vibrating manner. It is considered that this is due to an excessive quantity of heat given to the fixing belt by the fixing device.

Moreover, a recent environmentally friendly fixing device has a fixing component with less heat capacity in order to reduce warm-up time. If such a member is used, the temperature ripple tends to be more conspicuous as large power is supplied to the fixing device. Particularly, if a so-called divided IH coil heating system is employed which uses different coils as IH coils at the center and both sides in the direction of width of the fixing belt, the temperature ripples increase further. This is because a large increase in belt temperature tends to cause a temperature difference between the center coil and the side coil which are alternately driven, and therefore the duty factor of driving pulses is increased. For power supply in feedback for once, the same quantity of power is supplied to the center coil and the side coil. Therefore, a vicious cycle occurs that the large duty factor causes increase in temperature difference. This causes uneven gloss, and in the worst case, it causes high-temperature offset. Moreover, because of the rising temperature within the machine, reduction in life of electronic components arranged near the fixing unit and fixation of toner thereto tend to occur.

In the conventional fixing device, temperature on the fixing belt is detected by a thermopile. The cycle of giving feedback in accordance with the temperature as a result of detection is the same cycle (200 ms) for both the normal paper mode and the thick paper mode. If the duty time is changed in accordance with the temperature difference between the center coil and the side coil but the temperature difference is not resolved in a prescribed time period, the maximum power is supplied to both coils. Therefore, in the thick paper mode, since the carrying speed is slow, the same feedback cycle as in the normal paper mode causes the maximum power to be supplied immediately and therefore a temperature ripple tends to occur.

It is an object of the invention to provide an image forming apparatus having a fixing device in which the conventional problems are improved.

SUMMARY

According to an aspect of the invention, in an image forming apparatus having a normal paper mode (normal speed) and a thick paper mode (deceleration), as a maximum quantity of power that is smaller than maximum power supply at the time of normal speed is set, excessive power supply is eliminated if the thick paper mode (deceleration) is selected. Thus, the fixing temperature ripple can be reduced and stable image quality, restrained temperature rise in the machine, and the life of machine components can be secured.

Moreover, according to another aspect of the invention, it is possible reduce the temperature ripple by setting a longer feedback cycle for controlling the temperature to a target temperature than in the normal paper mode and thereby preventing the maximum power from being supplied in a short time.

According to still another aspect of the invention, an image forming apparatus having a normal paper mode and a thick paper mode includes a scanning unit which scans an image of an original, a process unit which forms the image scanned by the scanning unit onto a sheet for image formation, and a fixing device which fixes the image formed on the sheet to the sheet by heating. The fixing device includes a fixing member, a center coil for induction-heating a substantially central part of the fixing member, a side coil which is arranged at least one side of the center coil and adapted for induction-heating an end part of the fixing member, an induction heating power source which supplies a high-frequency pulse voltage to the center coil and the side coil, and a power control circuit which variably controls output power of the induction heating power source so that the output power increases or decreases stepwise on a predetermined cycle, and has a function of selectively setting maximum power supply and a function of selectively setting the output power variance cycle. If the thick paper mode is selected, the maximum power supply of the induction heating power source is set to a smaller value than the maximum power supply in the normal paper mode, and the output power variance cycle is set to a larger value than the output power variance cycle in the normal paper mode.

Here, the "fixing member" refers to a fixing roller or a fixing belt laid over the fixing roller. The "substantially central part of the fixing member" refers to a central part in the axial direction in the case of the fixing roller, and a central part in the direction of width in the case of the fixing belt. The "end part of the fixing member" refers to an end part in the axial direction in the case of the fixing roller, and an end part in the direction of width in the case of the fixing belt.

According to still another aspect of the invention, in the image forming apparatus, the fixing device further includes a fixing belt laid over the fixing roller, a fixing belt center temperature sensor which detects a surface temperature of a substantially central part in the direction of width of the fixing belt, and a fixing belt side temperature sensor which detects a surface temperature of at least one end part in the direction of width of the fixing belt. The power control circuit variably controls the output power of the induction heating power source so that the output power increases or decreases stepwise until the temperature detected by the fixing belt center temperature sensor or the fixing belt side temperature sensor reaches a predetermined temperature.

According to still another aspect of the invention, in the image forming apparatus, the power control circuit includes a temperature comparison unit which compares a detected temperature T1 from the fixing belt center temperature sensor or a detected temperature T2 from the fixing belt side temperature sensor with a target temperature Ts on a predetermined power variance cycle, and a power variable control unit which increase or decreases the output power of the induction heating power source by a predetermined unit quantity if the detected temperature T1 or T2 differs from the target temperature Ts.

DETAILED DESCRIPTION

Hereinafter, an embodiment of the invention will be described in detail with reference to the drawings.

Figure 1:
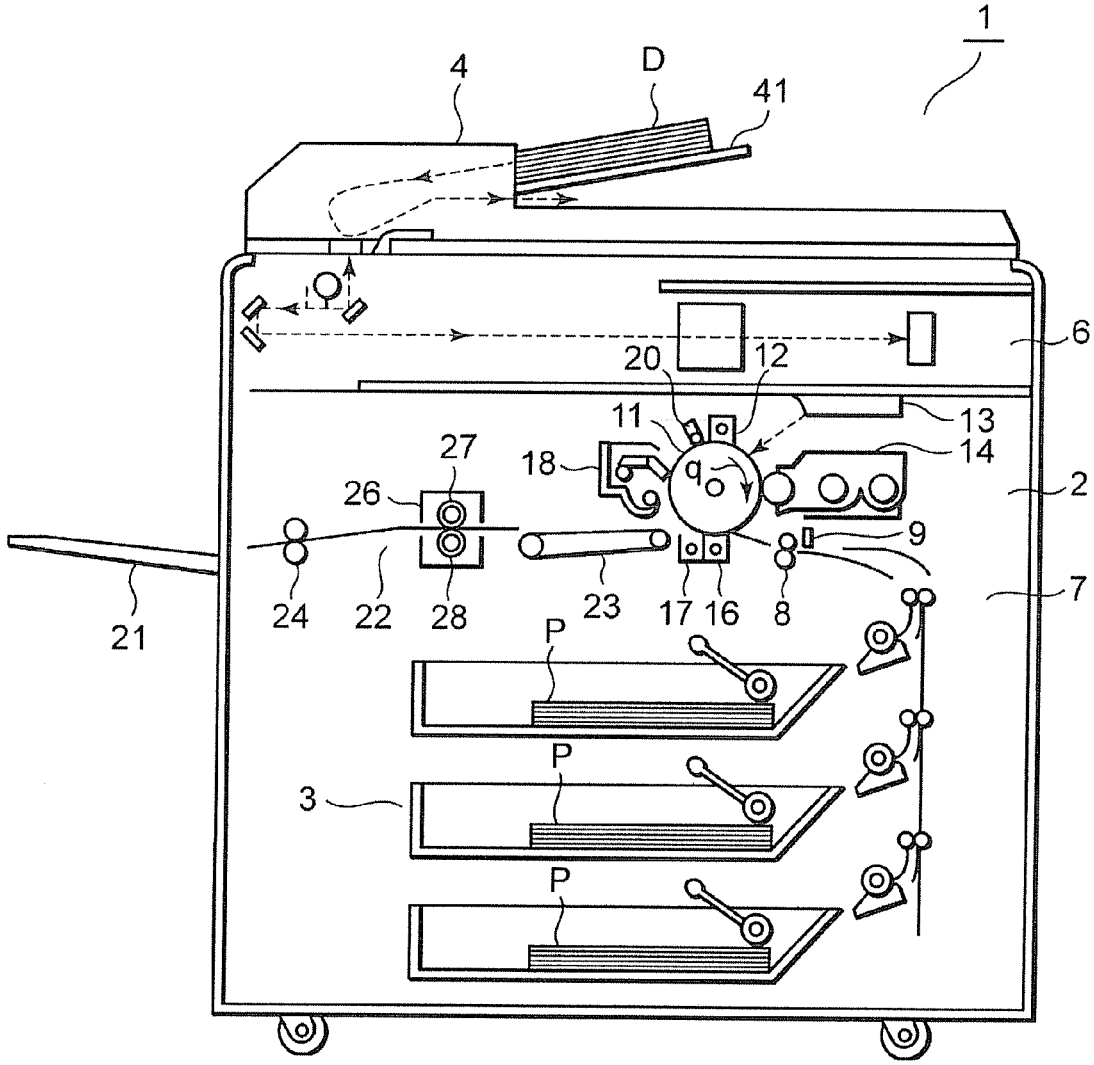
FIG. 1 is a view of schematic configuration showing the overall configuration of a copy machine as an example of an image forming apparatus according to an embodiment of the invention

FIG. 1 is a view of schematic configuration showing the overall configuration of a copy machine as an example of an image forming apparatus according an embodiment of the invention. An image forming apparatus 1 has a cassette system 3 which supplies a sheet P as a recording medium to an image forming unit 2. The image forming apparatus 1 has, on its top, a scanner device 6 which scans an original D supplied by an auto document feeder 4. A registration roller 8 is provided on a carrying path 7 extending from the cassette system 3 to the image forming unit 2.

The image forming unit 2 has, around a photoconductive drum 11, a charger device 12 which uniformly charges the photoconductive drum 11, a laser exposure device 13 which forms a latent image based on image data from the scanner device 6 onto the charged photoconductive drum 11, a developing device 14, a transfer charger 16, a separation charger 17, a cleaner 18, and a neutralizing LED 20, sequentially in accordance with the rotating direction of the photoconductive drum 11 indicated as q. The image forming unit 2 forms a toner image on the photoconductive drum 11 by an image forming process using a known electrographic system and transfers the toner image to the sheet P.

In the image forming unit 2, a paper discharge carrying path 22 which carries the sheet P with the toner image transferred thereto, in the direction of a paper discharge unit 21, is provided downstream in the carrying direction of the sheet P. On the paper discharge carrying path 22, a carrying belt 23 which carries the sheet P separated from the photoconductive drum 11 to the fixing device 26, and a paper discharge roller 24 which discharges the sheet P after passing through the fixing device 26, to the paper discharge unit 21, are provided. The fixing device 26 includes a heat roller 27, and a pressurizing roller 28 which pressurizes and contacts the heat roller 27, for example, with a pressure of 40 kg.

The configuration of the fixing device 26 will be described with reference to FIG. 2 and FIG. 3.

The fixing device 26 heats a fixing belt and a fixing roller by electromagnetic induction (IH) heating using divided coils. The fixing device 26 includes a fixing roller 30, a strip-like fixing belt 31 which is wound on the fixing roller 30 and heated, and a tension roller 32 on which the fixing belt 31 is wound and which gives tension to this belt. The traveling speed of the fixing belt 31 is the process speed of the fixing device. The fixing device also includes an induction heating coil 33 which directly heats the fixing belt 31 from outside by IH heating, an induction heating power source 34 which supplies power to the induction heating coil 33, a fixing belt temperature sensor 35 which detects the surface temperature of the fixing belt 31, and a fixing belt temperature control unit 36 which controls the induction heating power source 34 in order to control the temperature of the outer surface of the fixing belt in accordance with the temperature detected by the fixing belt temperature sensor 35. The fixing device 26 further includes a pressurizing roller 37 which is provided to face the fixing roller 30 with the fixing belt 31 wound thereon and is pressed in contact from the back side of the recording paper P, a central heater 38*a* and both-ends heater 38*b* built in the pressurizing roller 37, a temperature sensor 39 which detects the temperature of the outer surface of the pressurizing roller 37, and a heater control unit 40 which controls electrification of the central heater 38*a* and the both-ends heater 38*b* in accordance with the temperature detected by the temperature sensor 39.

Figure 3:
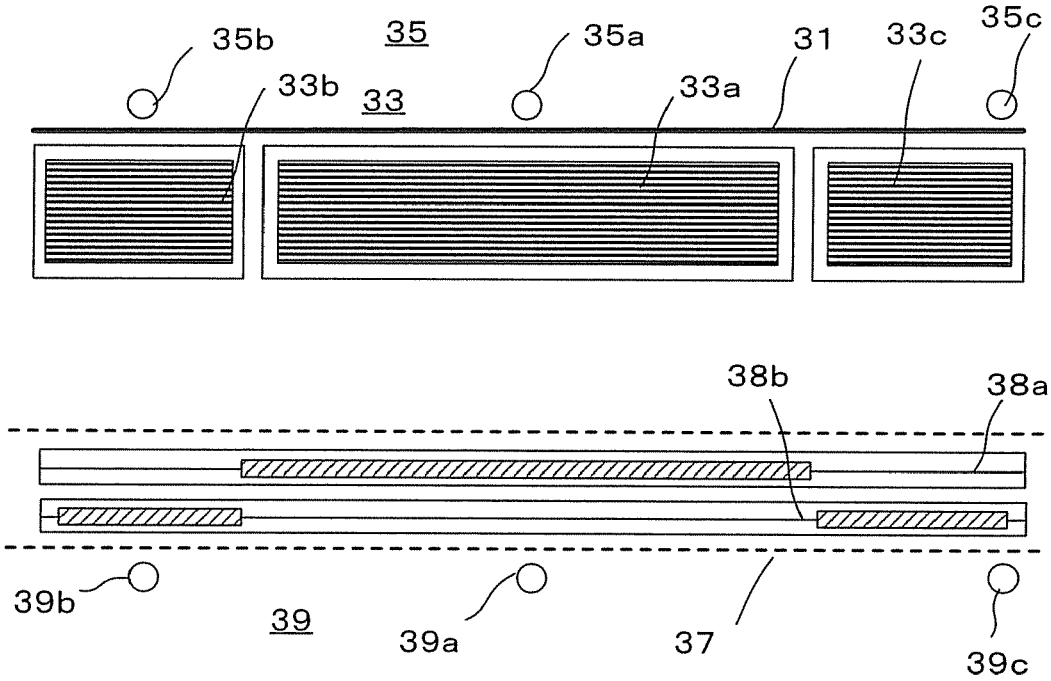
FIG. 3 is a view of schematic configuration showing the configuration of divided coils included in the fixing device shown in FIG. 1.

FIG. 3 is a top view showing the relation between the structure of the induction heating coil 33 and the temperature sensor 35, and the relation between the pressurizing roller 37 and the temperature sensor 39. As shown in FIG. 3, the induction heating coil 33 is divided into three parts in the axial direction of the pressurizing roller 37. That is, the induction heating coil 33 includes a center coil 33*a* at the center and two side coils 33*b*, 33*c* arranged on both sides of the center coil. A part or all of these coils are driven depending on the size of the recording paper. The fixing belt 31 is accordingly heated by electromagnetic induction heating in the direction of width. The center coil 33*a* and the side coils 33*b*, 33*c* are driven by an alternate driving method. As this is repeated, the fixing belt 31 is maintained at a predetermined temperature.

The fixing belt temperature sensor 35 includes a fixing belt center temperature sensor 35*a* provided at the position corresponding to the center of the center coil 33*a* on the fixing belt 31, a fixing belt side temperature sensor 35*b* provided at the position corresponding to the center of the side coil 33*b*, and a fixing belt abnormal temperature sensor 35*c* which is provided near the outer end of the side coil 33*c* and adapted for detecting anomaly.

The pressurizing roller 37, facing and pressed in contact with the fixing belt 31, includes the central heater 38*a* having a heating unit to mainly heat the central part with respect to the axial direction on its surface, and the both-ends heater 38*b* having heating parts to mainly heat both end parts. The heating part of the central heater 38*a* corresponds to the center coil 33*a* of the induction heating coil 33. The heating parts of the both-ends heater 38*b* correspond to the side coils 33*b*, 33*c* of the induction heating coil 33.

The pressurizing roller temperature censor 39, which detects the surface temperature of the pressurizing roller 37, includes a pressurizing roller center temperature sensor 39*a* provided near the center of the pressurizing roller 37 in order to detect the temperature of the central part of the pressurizing roller 37, a pressurizing roller side temperature sensor 39*b* provided near the center of one heating part of the both-ends heater 38*b*, and a pressurizing roller abnormal temperature sensor 39*c* provided near the end of the other heating part of the both-ends heater 38*b*.

Figure 2:
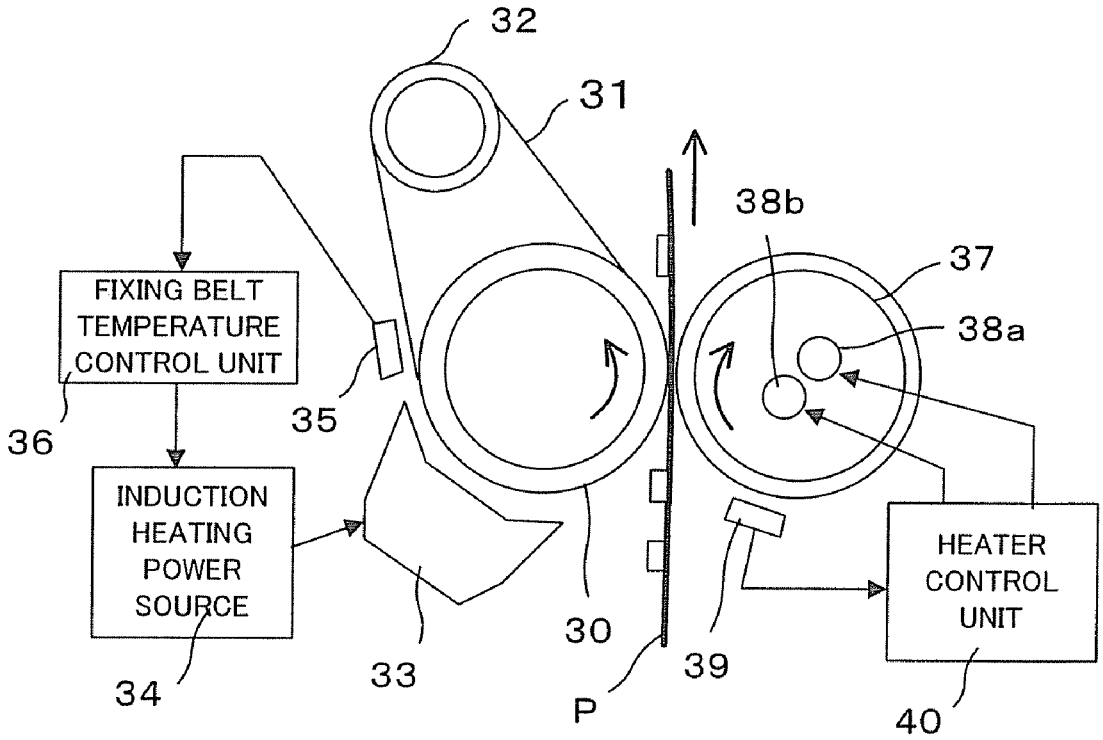
FIG. 2 is a view of schematic configuration showing the configuration of a fixing device shown in FIG. 1.

The surface temperatures detected by the pressurizing roller center temperature sensor 39*a* and the pressurizing roller side temperature sensor 39*b* in the axial direction of the pressurizing roller 37 are inputted to the heater control unit 40 of FIG. 2. The heater control unit 40 selectively electrifies the corresponding central heater 38*a* or both-ends heater 38*b*. That is, if a temperature fall on the surface of the pressurizing roller 37 is detected only by the pressurizing roller center temperature sensor 39*a*, the heater control unit 40 electrifies the central heater 38*a*. If a temperature fall on the surface of the pressurizing roller 37 is detected by the pressurizing roller center temperature sensor 39*a* and the pressurizing roller side temperature sensor 39*b*, the heater control unit 40 electrifies the central heater 38*a* and the both-ends heater 38*b*.

The fixing belt center temperature sensor 35*a*, the fixing belt side temperature sensor 35*b*, the fixing belt abnormal temperature sensor 35*c*, the pressurizing roller center temperature sensor 39*a*, the pressurizing roller side temperature sensor 39*b*, and the pressurizing roller abnormal temperature sensor 39*c* include a thermistor or thermopile. The fixing belt abnormal temperature sensor 35*c* and the pressurizing roller abnormal temperature sensor 39*c* are temperature sensors for detecting abnormal heating in the side coil 33*c* and the end part of the both-ends heater 38*b*. The fixing belt center temperature sensor 35*a* and the pressurizing roller center temperature sensor 39*a* are to detect temperature change (rise and fall) due to passage of a sheet, in the center coil 33*a* and the central part of the pressurizing roller 37. The fixing belt side temperature sensor 35*b* and the pressurizing roller side temperature sensor 39*b* are to detect temperature change due to passage of a sheet, in the side coil 33*b* and the lateral end part of the pressurizing roller.

In some cases, an excessively large current is caused to flow through the center coil 33*a* and the side coils 33*b*, 33*c*. Since these coils are heated, their thermal change is significant. Therefore, the temperature sensors 39*a* and 39*b* on the side of the pressurizing roller 37 have less quick change in detected temperature than the temperature sensors 35*a* and 35*b* on the IH coil side, and are advantageous in stable detection of temperature.

Figure 4:
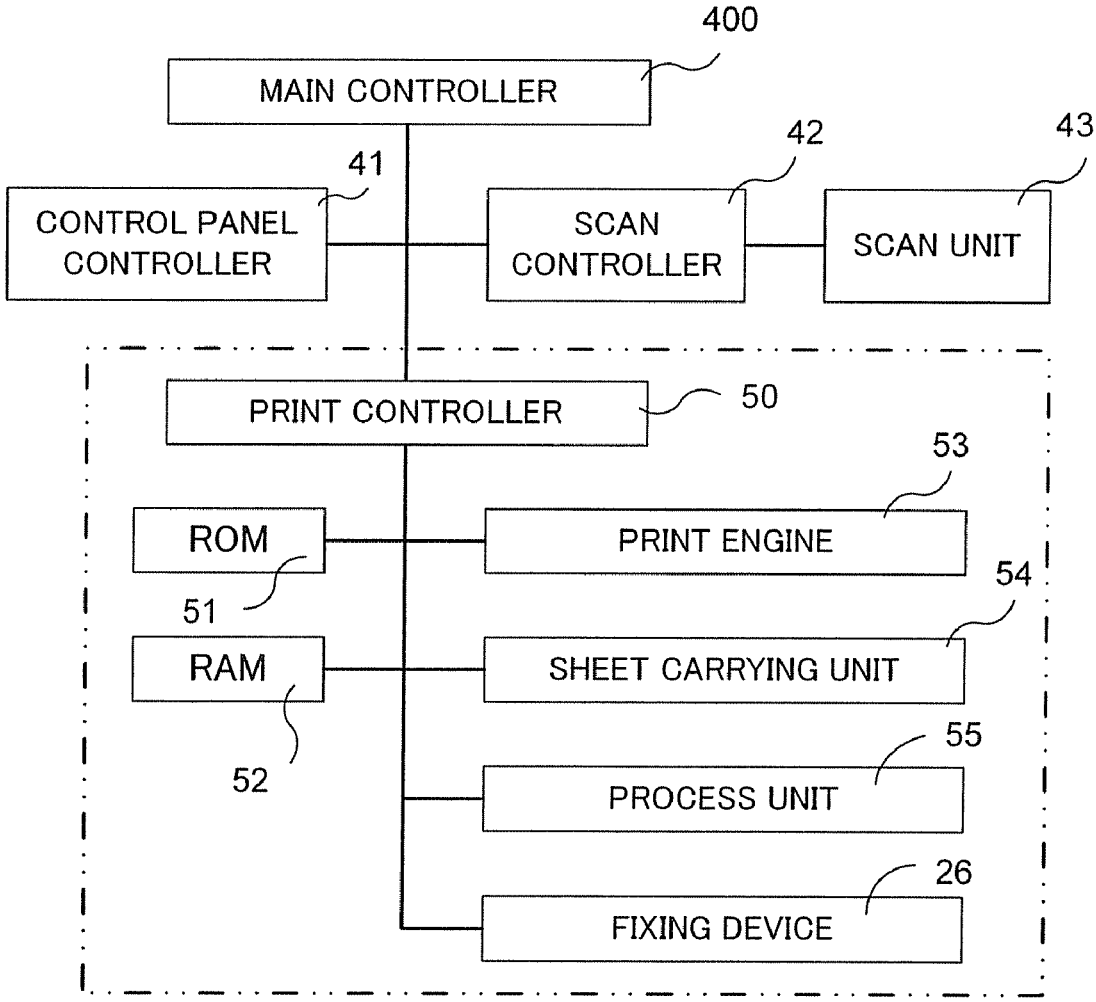
FIG. 4 is a block diagram showing a control circuit of the image forming apparatus.

FIG. 4 is a block diagram showing the control circuit of the image forming apparatus.

A control panel controller 41 and a scan controller 42 are connected to a main controller 400. The scan controller 42 is connected to a scan unit 43. Also a print controller 50 is connected to the main controller 400. The main controller 400 comprehensively controls the control panel controller 41, the scan controller 42 and the print controller 50. The scan controller 42 controls the scan unit 43 which optically scans an image of an original.

A ROM 51 for storing a control program, a RAM 52 for storing data, a print engine 53, a sheet carrying unit 54, a process unit 55, and the fixing device 26 are connected to the print controller 50. The print engine 53 emits a laser beam for forming an image scanned by the scan unit 43 onto the photoconductive drum in the process unit 55. The sheet carrying unit 54 includes a carrying system for the sheet P, its driving circuit and so on. The process unit 55 forms an electrostatic latent image corresponding to the image scanned by the scan unit 43 onto the surface of the photoconductive drum by using the laser beam emitted from the print engine 53, then develops the electrostatic latent image on the photoconductive drum with a developer, and transfers the developer image to the sheet P.

Figure 5:
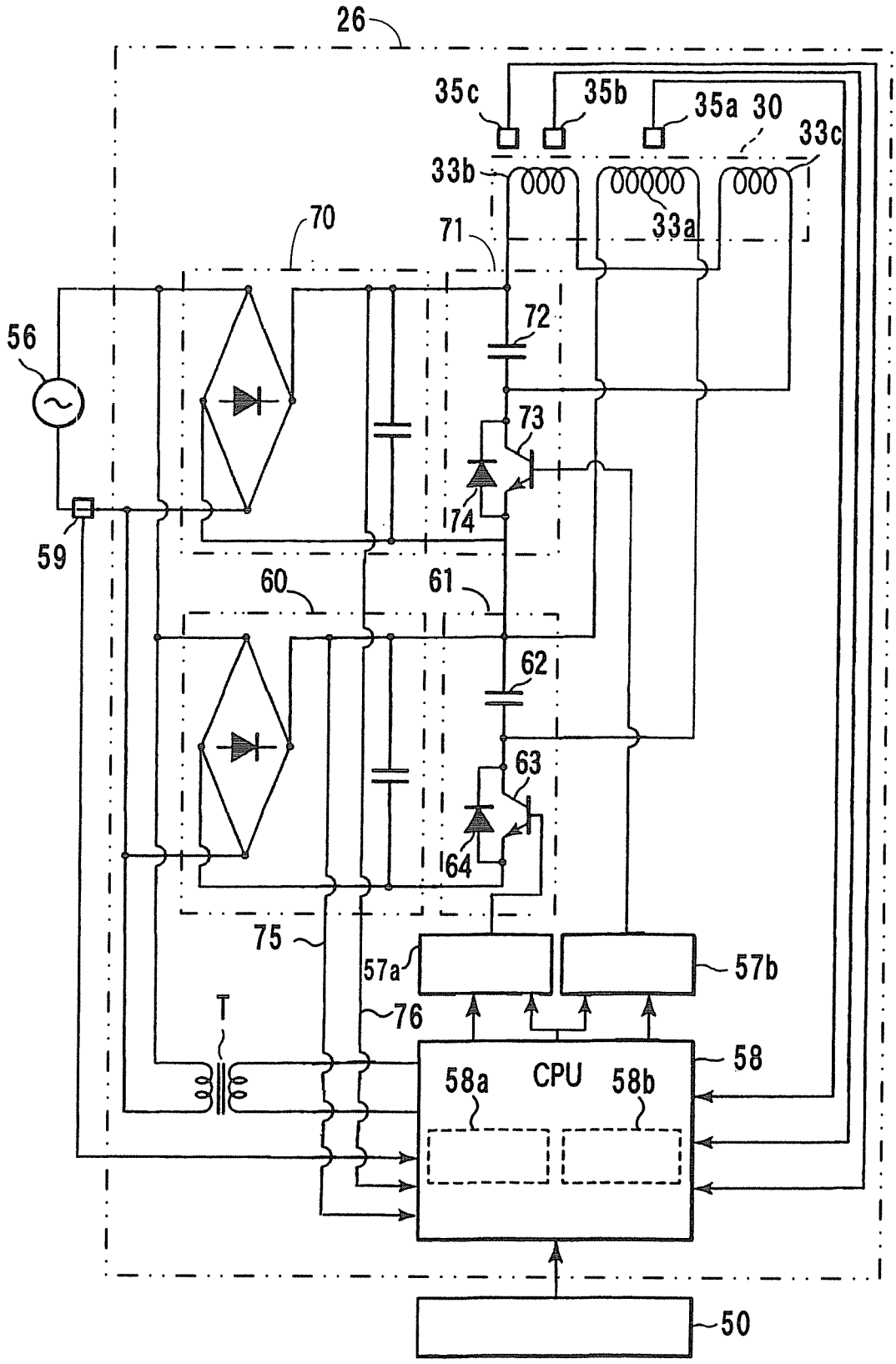
FIG. 5 is a block diagram showing an electric circuit in the fixing device shown in FIG. 1.

FIG. 5 is a block diagram showing an electric circuit in the fixing device 26.

A CPU 58 is connected to a commercial AC power source 56 via a step-down transformer T. Also rectifier circuits 60 and 70 are connected to the commercial AC power source 56. High frequency generating circuits (also referred to as switching circuits) 61 and 71 are connected to the outputs of the rectifier circuits 60 and 70.

The high frequency generating circuit 61 includes a resonance capacitor 62 which forms a resonance circuit together with the center coil 33*a*, a switching element, for example, a transistor 63 which excites the resonance circuit, and a damper diode 64 connected parallel to the transistor 63. In the high frequency generating circuit 61, a high-frequency current is generated as the transistor 63 is driven on or off by a center coil driving circuit 57*a*. Therefore, the rectifier circuit 60 and the high frequency generating circuit 61 serve as a power source for supplying a high-frequency pulse signal to the center coil 33*a*, that is, a center coil power source.

The high frequency generating circuit 71 includes a resonance capacitor 72 which forms a resonance circuit together with the side coils 33*b*, 33*c*, a switching element, for example, a transistor 73 which excites the resonance circuit, and a damper diode 74 connected parallel to the transistor 73. In the high frequency generating circuit 71, a high-frequency current is generated as the transistor 73 is driven on or off by a side coil driving circuit 57*b*. Therefore, the rectifier circuit 70 and the high frequency generating circuit 71 serve as a power source for supplying a high-frequency pulse signal to the side coils 33*b*, 33*c*, that is, a side coil power source.

A pulse-width-modulated driving pulse is supplied from the CPU 58 to each of the center coil driving circuit 57*a* and the side coil driving circuit 57*b*, as will be described later. The pulse width of the driving pulse is variably controlled by a command signal from the image forming apparatus to the CPU 58. With this driving pulse, the output frequency of the high frequency generating circuit 61 or the high frequency generating circuit 71 is changed. Consequently, power supplied to the center coil 33*a* or the side coils 33*b*, 33*c* is changed.

As a high-frequency current is supplied to the center coil 33*a* and the side coils 33*b*, 33*c*, a high-frequency magnetic field is generated from the center coil 33*a* and the side coils 33*b*, 33*c*. This high-frequency magnetic field causes an eddy-current to be generated in the metal member of the fixing roller 30. Joule heat based on the eddy-current causes the metal member to self-heat.

The fixing belt center temperature sensor 35*a*, the fixing belt side temperature sensor 35*b*, the fixing belt abnormal temperature sensor 35*c*, the print controller 50, the center coil driving circuit 57*a* and the side coil driving circuit 57*b* are connected to the CPU 58. Moreover, an output current from the commercial AC power source 56 is detected by a current detection circuit 59 and is supplied to the CPU 58 as an input current value to the high frequency generating circuits 61 and 71. Also, output voltages of the rectifier circuits 60 and 70 are supplied to the CPU 58 via wires 75 and 76 as input voltage values to the high frequency generating circuits 61 and 71.

The CPU 58 has a power control unit 58*a* and a coil switch control unit 58*b*. The power control unit 58*a* controls power supplied to the center coil 33*a* and the side coils 33*b*, 33*c* so that a detected temperature T1 from the fixing belt center temperature sensor 35*a* and a detected temperature T2 from the fixing belt side temperature sensor 35*b* are maintained at a predetermined set temperature Ts.

Figure 6:
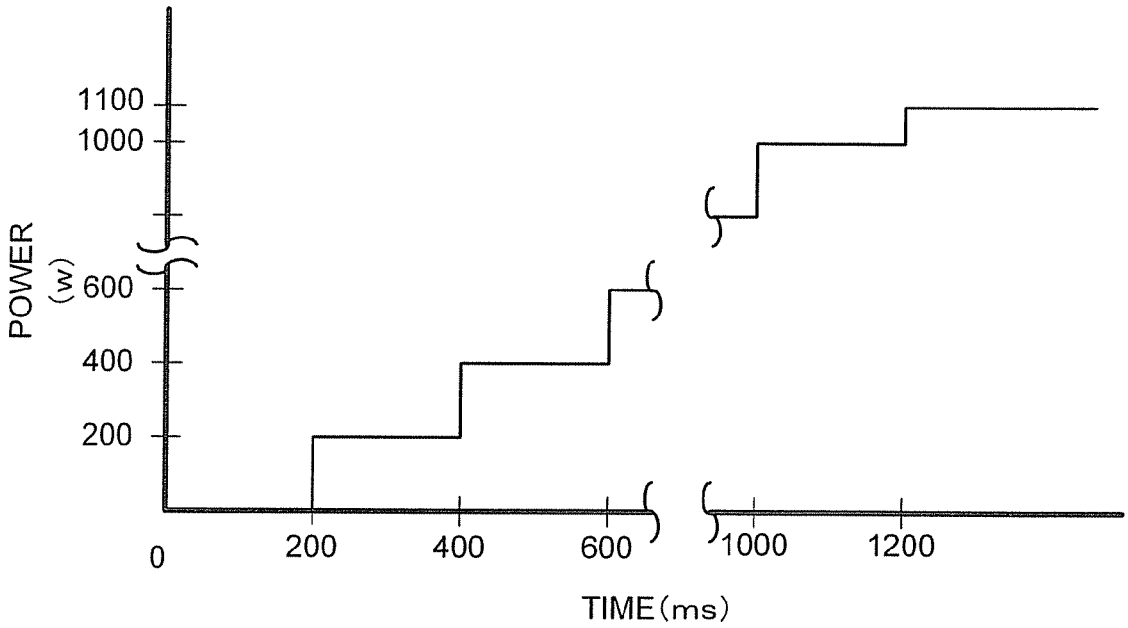
FIG. 6 is a graph showing change in power supplied to a center coil 33*a* and side coils during a warm-up (W/P) period when starting up the image forming apparatus.

FIG. 6 is a graph showing change in power supplied to the center coil 33*a* and the side coils 33*b*, 33*c* during a warm-up (W/U) period when starting up the image forming apparatus. In FIG. 6, the horizontal axis represents time and the vertical axis represents output power of the high frequency generating circuits 61 and 71. The quantity of power supplied to each coil is controlled to sequentially increase stepwise, for example, by 200 W every 200 ms, as shown in FIG. 6, until the surface temperature of the fixing belt 31 reaches a target temperature. This control is executed by the power control unit 58*a* of the CPU 58 in accordance with a command from the print controller 50 shown in FIG. 5.

The coil switch control unit 58*b* controls supply of high-frequency power to the center coil 33*a* and the side coils 33*b*, 33*c* so that the temperature difference between the detected temperature T1 from the fixing belt center temperature sensor 35*a* and the detected temperature T2 from the fixing belt side temperature sensor 35*b* is maintained at the same value or within a predetermined range of values.

Figures 7, 8:
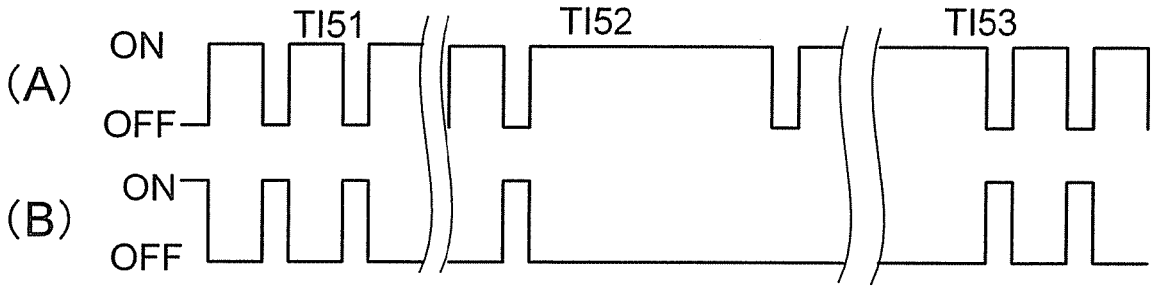
FIG. 7 shows waveforms of a coil switch control pulse outputted from a coil switch control unit of a CPU.
FIG. 8 shows a format representing operation patterns to alternately operate the center coil and the side coils.

FIG. 7 shows waveforms of a coil switch control pulse outputted from the coil switch control unit 58*b* of the CPU 58. FIG. 7(A) shows a switch pulse waveform for on-off control of the center coil driving circuit 57*a*. During the on-period of this pulse, the center coil driving circuit 57*a* operates. The center coil driving circuit 57*a* amplifies a PWM modulation pulse supplied from the power control circuit 58*a* of the CPU 58, then supplies the amplified pulse to the high frequency generating circuit 61, and thus performs on-off control of the transistor 63, which is the switching element of the high frequency generating circuit 61. A high-frequency output of the high frequency generating circuit 61 is supplied to the center coil 33*a*. During the off-period of the switch pulse waveform shown in FIG. 7(A), the operation of the center coil driving circuit 57*a* is stopped, and no PWM modulation pulse is supplied to the high frequency generating circuit 61. Consequently, the output supply to the center coil 33*a* from the high frequency generating circuit 61 is stopped.

FIG. 7(B) shows a switch pulse waveform for on-off control of the side coil driving circuit 57*b*. During the on-period of this pulse, the side coil driving circuit 57*b* operates. The side coil driving circuit 57*b* amplifies a PWM modulation pulse supplied from the power control circuit 58*a* of the CPU 58, then supplies the amplified pulse to the high frequency generating circuit 71, and thus performs on-off control of the transistor 73, which is the switching element of the high frequency generating circuit 71. A high-frequency output of the high frequency generating circuit 71 is supplied to the side coils 33*b*, 33*c*. During the off-period of the switch pulse waveform shown in FIG. 7(B), the operation of the side coil driving circuit 57*b* is stopped, and no PWM modulation pulse is supplied to the high frequency generating circuit 71. Consequently, the output supply to the side coils 33*b*, 33*c* from the high frequency generating circuit 71 is stopped.

As is clear from FIG. 7, if one of the switch pulse waves shown in FIG. 7 is at ON level, the other is at OFF level. Therefore, as described before, during the period when the waveform of FIG. 7(A) is at ON level, the high-frequency output from the high frequency generating circuit 61 is supplied to the center coil 33*a*. During this period, the waveform of FIG. 7(B) is at OFF level and therefore the high-frequency output from the high frequency generating circuit 71 is not supplied to the side coils 33*b*, 33*c*. On the contrary, during the period when the waveform of FIG. 7(A) is at OFF level, the high-frequency output from the high frequency generating circuit 61 is not supplied to the center coil 33*a*. During this period, the waveform of FIG. 7(B) is at ON level and therefore the high-frequency output from the high frequency generating circuit 71 is supplied to the side coils 33*b*, 33*c*.

For these switch pulse waveforms, duty factors, which are ratios of ON and OFF periods, can be freely set. These different duty factors are stored in advance in the RAM 52 shown in FIG. 4 as operation patterns for alternately operating the center coil 33*a* and the side coils 33*b*, 33*c*. The format of these operation patterns is shown in FIG. 8.

Figure 9:
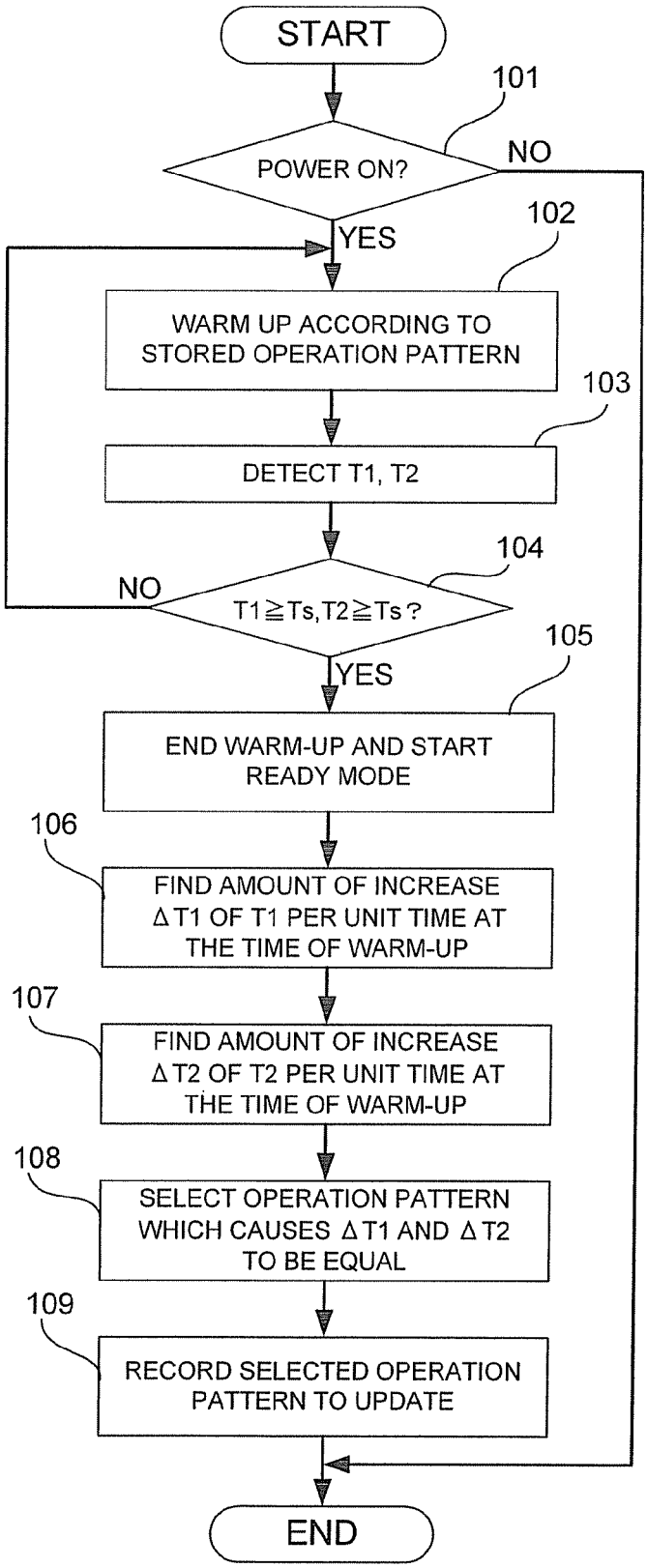
FIG. 9 is a flowchart for explaining the operation of the fixing device shown in FIG. 1.

FIG. 9 is a flowchart for explaining the operation of the fixing device.

When the commercial AC power source 56 is turned on (YES in ACT 101), warm-up is executed to operate the center coil 33*a* and the side coils 33*b*, 33*c* in accordance with the operation patterns stored in advance in the RAM 52 (ACT 102) Then, the temperature T1 at a substantially central part of the fixing belt 31 or the pressurizing roller 37 (FIG. 2) and the temperature T2 at one end part are detected by the fixing belt center temperature sensor 35*a* and the fixing belt side temperature sensor 35*b* (ACT 103). As both these detected temperatures T1 and T2 reach the preset temperature Ts (YES in ACT 104), warm-up ends and the ready mode starts (ACT 105).

When warm-up is finished, the amount of increase ΔT1 per unit time t of the detected temperature T1 at the time of warm-up is found (ACT 106). Moreover, the amount of increase ΔT2 per unit time t of the detected temperature T2 at the time of warm-up is found (ACT 107). An operation pattern which causes the amount of increase ΔT1 and the amount of increase ΔT2 to be equal is selected from the various operation pattern in the ROM 51 (ACT 108).

Here, with reference to FIG. 8, in the standard operation pattern "17", the operating time of the center coil 33*a* is 1 second and the operating time of the side coils 33*b*, 33*c* is 1 second as well. The duty factor of the driving pulse waves is (10:10). If the amount of increase ΔT1 per unit time of the detected temperature T1 at the time of warm-up is greater than the amount of increase ΔT2 of the detected temperature T2, one of the operations patterns "18", "19", "20", "21" and "22" is selected in order to increase the amount of increase ΔT2. For example, in the operation pattern "18", the operating time of the center coil 33*a* is 1 second and the operating time of the side coils 33*b*, 33*c* is 1.1 seconds. The duty factor is (10:11). In the operation pattern "19", the operating time of the center coil 33*a* is 1 second and the operating time of the side coils 33*b*, 33*c* is 1.2 seconds. The duty factor is (10:12). In the operation pattern "20", the operating time of the center coil 33*a* is 1 second and the operating time of the side coils 33*b*, 33*c* is 1.3 seconds. The duty factor is (10:13). The selected operation pattern is recorded to update the RAM 52 (ACT 109).

The image forming apparatus 1 according to the embodiment of the invention shown in FIG. 1 has a normal paper mode (a first image forming mode) and a thick paper mode(a second image forming mode). In the normal paper mode, the traveling speed of the carrying belt 23 which carries the sheet P separated from the photoconductive drum 11 to the fixing device 26 is a normal speed, for example, 180 mm/s. However, in the thick paper mode, the speed is decelerated from the normal speed. If the normal paper mode is selected, since the copy speed is fast, a large quantity of heat is deprived of by the sheet P. Thus, the maximum allowable power of the fixing device, for example, 1110 W, is supplied in order to maintain the target temperature.

Meanwhile, if the thick paper mode is selected, the speed is ½ or ⅓ of the normal speed though the sheet has a large basis weight. Therefore, power for fixation can be ½ or ⅓ of the power used for normal paper. In such a case, if the conventional temperature control is employed and IH divided control is used, high-frequency power that is alternately supplied to the center coil 33*a* and the side coils 33*b*, 33*c* is controlled in accordance with the difference between the temperature difference between the center coil 33*a* and the side coils 33*b*, 33*c*, and the target temperature.

That is, if the temperature T1 at the substantially central part of the fixing belt 31 or the pressurizing roller 37 does not reach the target temperature Ts within a predetermined time, or if the temperature difference between the center coil 33*a* and the side coils 33*b*, 33*c* does not reach zero within a predetermined time, the duty factor of the driving pulse waveforms is changed so that the time of applying a high-frequency signal to the center coil 33*a* becomes longer. In parallel with this, if the target temperature is not reached, fixing control is performed so that the quantity of power supplied to each coil is varied, for example, by 200 W every 200 ms, to achieve the target temperature. At this time, if the target temperature is not reached, the quantity of power supply is sequentially increased stepwise. Therefore, the maximum power is ultimately supplied.

In this manner, if the maximum power of IH heating for the normal speed is supplied also in the thick paper mode, excessive heat supply causes temperature overshoot and the temperature ripple tends to be more conspicuous.

If the lower limit of power in sequentially increasing the quantity of power supply stepwise as described above is defined as 200 W, the power supply is increased by 200 W every 200 ms and therefore 1000 W (maximum power) is reached in 200 ms×5 times=1 second. That is, 1000 W in this case is the maximum value of power available to the fixing device 26 in the entire image forming apparatus. This maximum value is the maximum quantity of power that can be used in the fixing device in order to satisfy the current consumption standard value. As for change in the duty factor, which is the ratio of power supply time to the center coil 33*a* and the side coils 33*b*, 33*c*, feedback is usually given on a 200-ms cycle. Even in this case, the duty factor reaches its maximum in 200 ms×5 times and heat is supplied to the coil(s) on one side for a long time. Thus, the temperature difference between the center coil 33*a* and the side coils 33*b*, 33*c* tends to significantly expand.

Thus, in the embodiment, the inventors carried out an experiment by changing the maximum quantity of power supplied to the fixing device and the power control feedback cycle in the normal paper mode, in the thick paper mode. That is, in the thick paper mode, the value of the maximum quantity of power supplied to the fixing device was decreased and the power control feedback cycle was made longer. The result of tests of measuring the temperature ripple on the fixing belt 31 under the conditions used for the maximum quantity of power and the power variance cycle in the conventional thick paper mode, and the conditions used in this embodiment, will be described with reference to FIG. 10 to FIG. 13.

Figure 10:
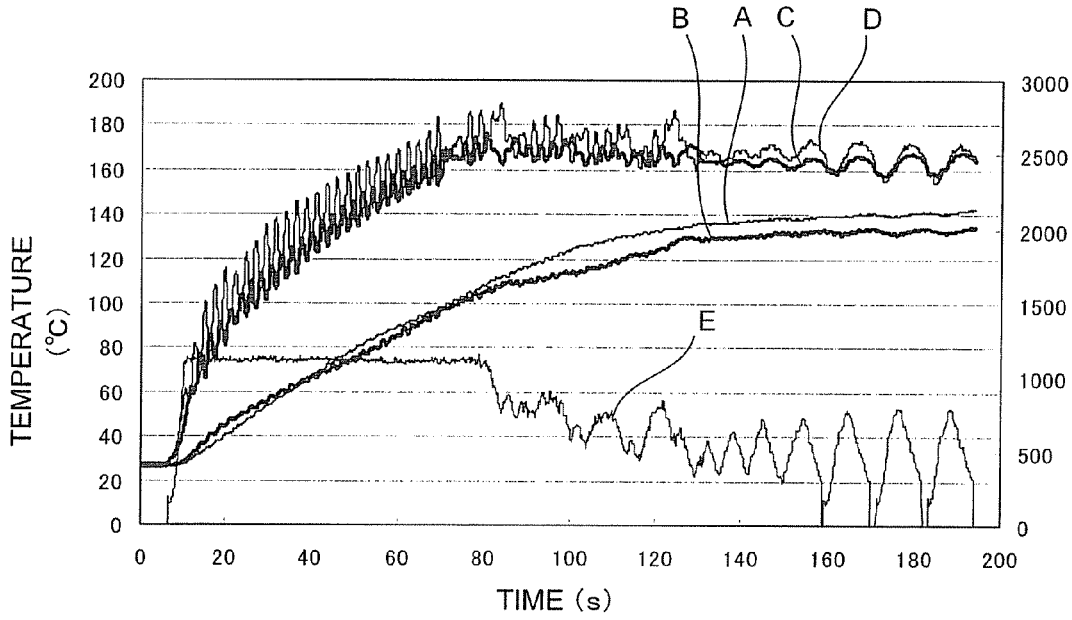
FIG. 10 is a graph showing the results of measuring the temperature on a fixing belt 31 and a fixing roller together with the quantity of power from high frequency generating circuits as heating sources, at the time of decelerated running in a thick paper mode of a conventional image forming apparatus for comparison.

FIG. 10 is a graph showing the results of measuring the temperature on the fixing belt 31 and the fixing roller 30 (FIG. 2) together with the quantity of power from the high frequency generating circuits 61 and 71 as heating sources, at the time of decelerated running (90 mm/s) in the conventional thick paper mode of the image forming apparatus, for comparison. In FIG. 10, the vertical axis represents temperature (° C.) and power (W) and the horizontal axis represents time (second). A curve A in FIG. 10 shows the detected temperature by using a thermocouple at the central part on the fixing belt. Similarly, a curve B shows the detected temperature by using a thermocouple at both end parts on the fixing belt, a curve C at the central part of the pressurizing roller 37, and a curve D at both end parts of the pressurizing roller. A curve E shows supplied power at the time. The maximum power supply to the fixing device 26 in this case is 1100 W during the warm-up period and 900 W during the ready period. The power control feedback cycle is 200 ms.

Transition of the duty factor of the coil switch pulses shown in FIG. 7 in this case is as follows. That is, the rate at which heating is carried out in the proportion of center to side=10:10 is 56.2%, 5.3% for 20:10 or 10:20, 13.1% for 30:10 or 10:30, and 25.4% for 40:10 or 10:40. Thus, it can be understood that the time of electrifying the coil(s) on one side with maximum power is long, causing a large temperature ripple.

Figure 11:
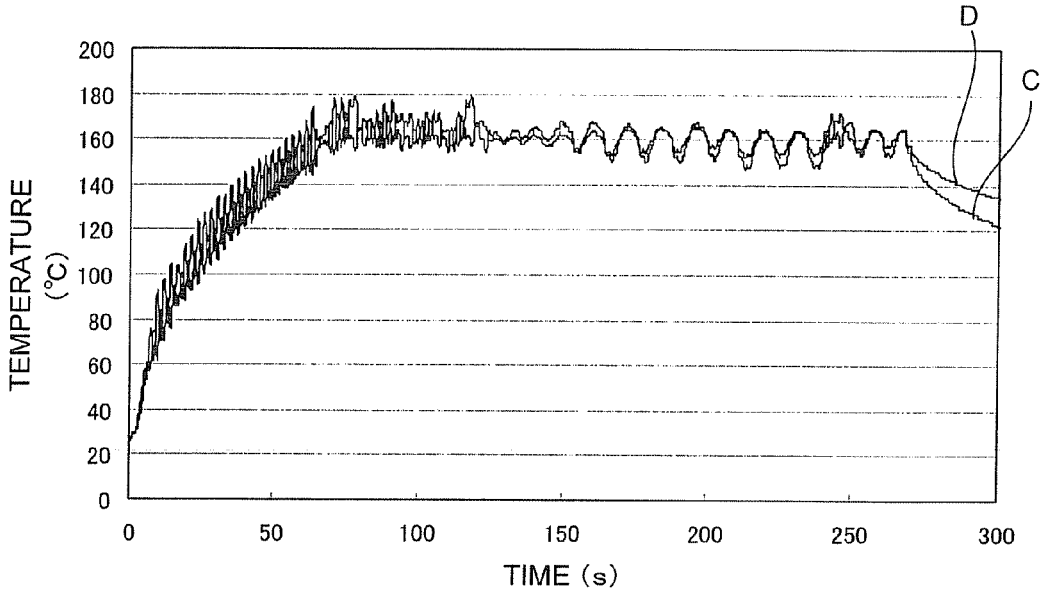
FIG. 11 is a graph showing temperature ripple in the thick paper mode under the testing conditions described with respect to FIG. 10, by using a thermopile which detects the surface temperature on the fixing belt.

FIG. 11 is a graph showing a temperature ripple in the thick paper mode under the test conditions described with reference to FIG. 10, by using a thermopile which detects the surface temperature on the fixing belt. Here, since the thermopile responds more quickly than the thermistor used for the measurement in FIG. 10, the temperature ripple can be measured more accurately. In FIG. 11, the vertical axis represents temperature (° C.) and the horizontal axis represents time (second). A curve C shows the detected temperature at the center part of the fixing belt 31. A curve D shows the detected temperature at the side part of the fixing belt 31. A curve E shows the quantity of power supplied to the fixing device.

Figure 12:
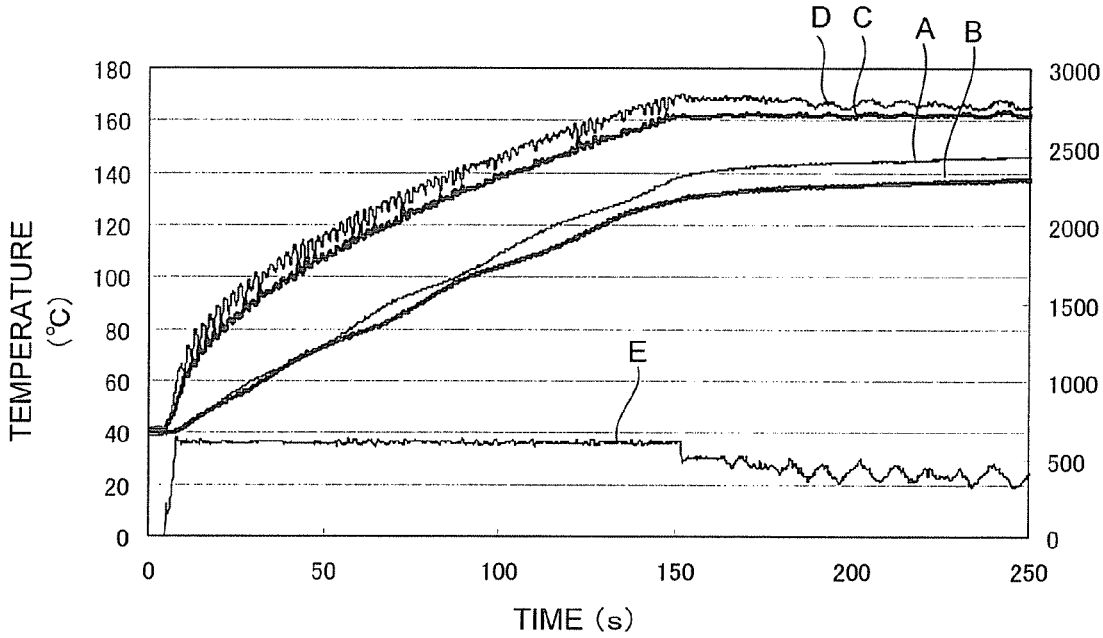
FIG. 12 is a graph showing the results of measuring the temperature on the fixing belt and the fixing roller together with the quantity of power from the high frequency generating circuits as heating sources, in the thick paper mode of the image forming apparatus according to the invention.

FIG. 12 is a graph showing the results of measuring the temperature on the fixing belt 31 and the fixing roller 30 (FIG.

2) together with the quantity of power from the high frequency generating circuits 61 and 71 as heating sources, in the thick paper mode (at the time of decelerated running at the speed of 90 mm/s) of the image forming apparatus according to the invention. The difference from FIG. 10 is that the maximum power supply is reduced to 600 W during the warm-up period and 500 W during the ready period, and that the feedback cycle is made longer to 800 ms. In FIG. 12, the vertical axis represents temperature (° C.) and power (W) and the horizontal axis represents time (second).

In FIG. 12, A shows the detected temperature at the central part on the fixing belt, B at both end parts on the fixing belt, C at the central part on the pressurizing roller, and D at both end parts on the pressurizing roller, by using a thermocouple. E shows supplied power at the time. The effect that power is reduced can be confirmed here.

Transition of the duty factor in this case is as follows. That is, the rate at which heating is carried out in the proportion of center to side=10:10 is 89%, 7.9% for 20:10 or 10:20, 2.5% for 30:10 or 10:30, and 0.5% for 40:10 or 10:40. Thus, it can be understood that the time of electrifying the coil(s) on one side with maximum power is short and each coil is evenly heated.

Figure 13:
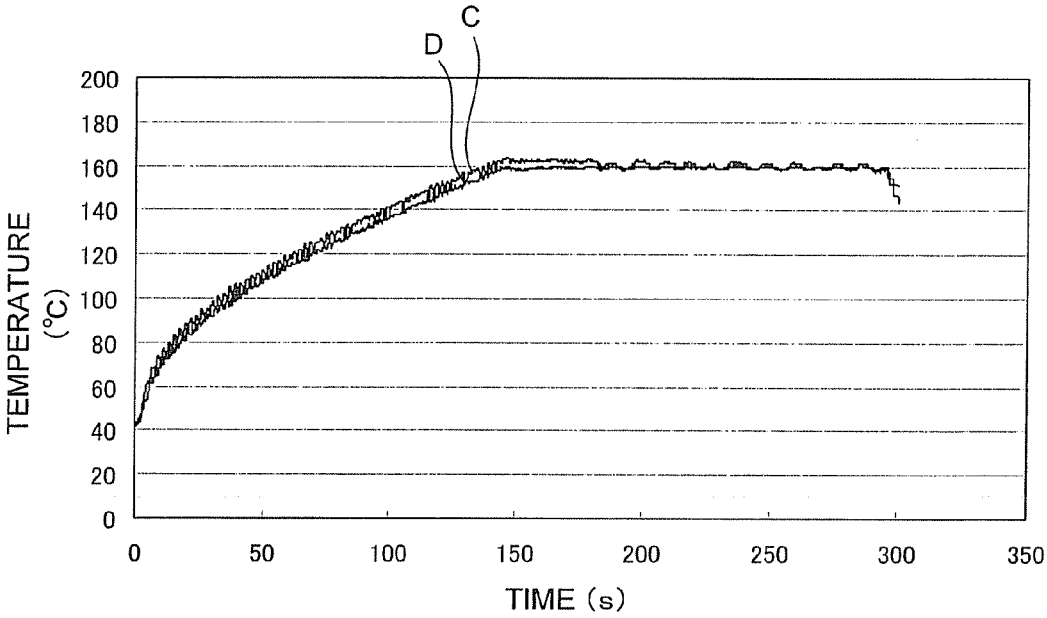
FIG. 13 is a graph showing the results of detecting the surface temperature on the fixing belt in the thick paper mode under the testing conditions described with respect to FIG. 12, by using a thermopile.

FIG. 13 is a graph showing the upper surface temperature of the fixing belt in the thick paper mode under the test conditions described with reference to FIG. 12, by using a thermopile. In FIG. 13, the vertical axis represents temperature (° C.) and the horizontal axis represents time (second). In FIG. 13, a curve C shows the detected temperature by a thermopile installed at the central part of the fixing belt. A curve D shows the detected temperature by thermopiles installed at both end parts on the fixing belt. Compared with FIG. 11, it is clear that the temperature rippled is reduced in FIG. 13.

As such a configuration is employed in the embodiment, in an image forming apparatus having a normal paper mode (normal speed) and a thick paper mode (deceleration), if print is carried out in the thick paper mode, a maximum quantity of power that is smaller than maximum power supply at the time of normal speed is set, thus preventing excessive power supply and reducing the fixing temperature ripple. Thus, stable image quality, restrained temperature rise in the machine, and the life of machine components can be secured.

Moreover, by setting a longer feedback cycle for power control until a target temperature is reached than in the normal paper mode, it is possible to extend the period before maximum power is supplied. Thus, the temperature ripple can be reduced as well.

For variable power control, during the ready period after the target temperature is reached, power is lowered stepwise from the maximum power on a 200-ms cycle. However, if the power switching time or the quantity of power switched in one stage is large, stable control cannot be carried out, causing an increased temperature ripple. If power switching is fast, power is quickly lowered to 200 W or below and turns off. If power is then turned on again, this alone causes a ripple of 10° C. or higher.

What is claimed is:

1. An image forming apparatus having a first image forming mode and a second image forming mode, the apparatus comprising:

a scanner which scans an image of an original;

an image forming device which forms the image based on the scanned image; and a fixing device which fixes the image formed on the sheet to the sheet by heating, the fixing device including:

a fixing member;

a center coil for induction-heating a substantially central part of the fixing member;

a side coil which is arranged at least one side of the center coil and adapted for induction-heating an end part of the fixing member;

an induction heating power source which supplies a high-frequency pulse voltage to the center coil and the side coil; and a power control circuit which variably controls output power of the induction heating power source so that the output power increases or decreases on a predetermined cycle, and controls to set the maximum power supply of the induction heating power source at the second image forming mode smaller than the maximum power supply in the first image forming mode.

2. The apparatus according to claim 1, wherein the fixing device further includes:

a fixing roller constituting the fixing member and a fixing belt laid over the fixing roller;

a fixing belt center temperature sensor which detects a surface temperature of a substantially central part in the direction of width of the fixing belt; and a fixing belt side temperature sensor which detects a surface temperature of at least one end part in the direction of width of the fixing belt;

wherein the power control circuit variably controls the output power of the induction heating power source so that the output power increases or decreases stepwise until the temperature detected by the fixing belt center temperature sensor or the fixing belt side temperature sensor reaches a predetermined temperature.

3. The apparatus according to claim 2, wherein the power control circuit includes a temperature comparison unit which compares a detected temperature T1 from the fixing belt center temperature sensor or a detected temperature T2 from the fixing belt side temperature sensor with a target temperature Ts on a predetermined power variance cycle, and a power variable control unit which increase or decreases the output power of the induction heating power source by a predetermined unit quantity if the detected temperature T1 or T2 differs from the target temperature Ts.

4. The apparatus according to claim 3, wherein the induction heating power source further includes:

a first high frequency generating circuit which supplies a high-frequency pulse voltage to the center coil;

a center coil driving circuit which drives the first high frequency generating circuit;

a second high frequency generating circuit which supplies a high-frequency pulse voltage to the side coil;

a side coil driving circuit which drives the second high-frequency generating circuit; and a coil switch control unit which alternately operates the center coil driving circuit and the side coil driving circuit with a predetermined duty factor, and compares the detected temperature T1 from the fixing belt center temperature sensor and the detected temperature T2 from the fixing belt side temperature sensor on a predetermined duty factor change cycle and changes the duty factor to make these detected temperatures coincident with each other if the detected temperatures are different from each other.

5. The apparatus according to claim 4, wherein the duty factor change cycle is the same as the power variance cycle.

6. The apparatus according to claim 5, wherein the side coil is arranged on both sides of the center coil.

7. The apparatus according to claim 6, wherein the process speed of the fixing device in the second image forming mode is half or one-third of the process speed in the first image forming mode.

8. The apparatus according to claim 7, wherein the maximum power supply of the induction heating power source is set to a value equal to or lower than 80% of maximum power supply in the first image forming mode.

9. The apparatus according to claim 8, wherein the power variance cycle of the induction heating power source is set to a time that is at least three times an output power variance cycle in the first image forming mode or longer.

10. The apparatus according to claim 9, wherein the duty factor change cycle by the coil switch control unit is equal to the output power variance cycle in the first image forming mode.

11. The apparatus according to claim 10, wherein a fixing belt of the fixing device is laid over a tension roller and is given tension.

12. The apparatus according to claim 10, wherein the induction heating power source has a rectifier circuit which converts commercial AC power supply to a DC current, and a DC output of the rectifier circuit is supplied to the first high frequency generating circuit and the second high frequency generating circuit.

13. The apparatus according to claim 11, wherein a first high frequency generating circuit and a second high frequency generating circuit include a switching element that is on-off controlled by a PWM modulation output pulse of the power control circuit.

14. The apparatus according to claim 8, wherein the maximum power supply of the induction heating power source is set to different values between a warm-up period before the surface temperature T1 or 12 reaches the target temperature Ts and a ready period after the target temperature Ts is reached, and the maximum power supply during the ready period is set to a smaller value than the maximum power supply during the warm-up period.

15. The apparatus according to claim 14, wherein the power variance cycle of the induction heating power source is set to a time that is at least three times an output power variance cycle in the first image forming mode or longer.

16. The apparatus according to claim 15, wherein the duty factor change cycle by the coil switch control unit is equal to the output power variance cycle in the first image forming mode.

17. A control method for an image forming apparatus having a normal paper mode and a thick paper mode and having a fixing device in which a fixing belt is heated by an induction heating power source, the method comprising:

setting the thick paper mode;

setting maximum power supply of the induction heating power source to a smaller value than maximum power supply in the normal paper mode; and variably controlling output power of the induction heating power source so that the output power increases or decreases stepwise on a predetermined cycle.

18. The method according to claim 17, wherein a power variance cycle of the induction heating power source is set to a time which is at least three times an output power variance cycle in the normal paper mode or longer.

19. The method according to claim 18, wherein the fixing device includes a center coil for induction-heating a substantially central part in a direction of width of the fixing belt, and a side coil which is arranged at least one side of the center coil and adapted for induction-heating an end part in a direction of width of the fixing belt, and an output of the induction heating power source is alternately supplied to the center coil and the side coil.

20. An image forming apparatus having a first image forming mode and a second image forming mode comprising:

a scanner which scans an image of an original;

an image forming device which forms the image based on the scanned image; and a fixing device which fixes the image formed on the sheet to the sheet by heating, the fixing device including:

a fixing member;

a center coil for induction-heating a substantially central part of the fixing member;

a side coil which is arranged at least one side of the center coil and adapted for induction-heating an end part of the fixing member;

an induction heating power source which supplies a high-frequency pulse voltage to the center coil and the side coil; and a power control circuit which variably controls output power of the induction heating power source with a predetermined cycle, and controls to set the output power variance cycle in the second image forming mode larger than the output power variance cycle in the first image forming mode.

* * * * *